United States Patent [19]

Belokin, Jr. et al.

[11] Patent Number: 4,984,693

[45] Date of Patent: Jan. 15, 1991

[54] PRODUCT DISPLAY SHELF

[75] Inventors: Paul Belokin, Jr.; Martin Belokin, both of Denton, Tex.

[73] Assignee: Martin Paul, Inc., Denton, Tex.

[21] Appl. No.: 556,325

[22] Filed: Jul. 20, 1990

[51] Int. Cl.[5] ..... A47F 5/00

[52] U.S. Cl. ..... 211/88; 211/90; 248/206.3

[58] Field of Search ..... 211/88, 87, 90, 70.6, 211/66, 65; 312/245; 248/205.5, 206.3, 206.4

[56] References Cited

U.S. PATENT DOCUMENTS

| | | | |
|---|---|---|---|
| D. 171,595 | 3/1954 | Harriton | 248/286.3 X |
| 1,226,231 | 5/1917 | Mack . | |
| 1,243,059 | 10/1917 | Friesleben | 211/90 |
| 1,291,349 | 1/1919 | Ackers | 211/87 |
| 2,472,058 | 6/1949 | Artley | 211/66 X |
| 3,469,711 | 9/1969 | Swaneck et al. . | |
| 4,343,172 | 8/1982 | Nordlund | 211/70.6 X |
| 4,376,521 | 3/1983 | Walters | 211/90 X |

FOREIGN PATENT DOCUMENTS 8100314 8/1982 Netherlands .

*Primary Examiner*—Robert W. Gibson, Jr.
*Attorney, Agent, or Firm*—Nilles & Nilles

[57] ABSTRACT

A product display shelf that can be detachably mounted on the inside surface of a transparent door panel of a cabinet in the unused space between the inside of the panel and the interior shelves of the cabinet. The display shelf has a horizontal shelf for supporting products; a back wall; suction-type attaching devices on the back wall for securing the shelf to the door panel inside surface; and a product retainer in spaced relation to the back wall. A plurality of vertical access openings are provided in the product retainer and spaced in close proximity to each other and a plurality of horizontal access openings are provided on the horizontal shelf and spaced in close proximity to each other. The vertical and horizontal access openings are dimensioned to provide an access space through which fingers may be conveniently inserted for placing products on and removing them from the horizontal shelf.

11 Claims, 4 Drawing Sheets

PRODUCT DISPLAY SHELF

BACKGROUND OF THE INVENTION

1 Field of the Invention

This invention relates to a cabinet and product display shelf therefor and more specifically to a display shelf for products of different vertical heights that is adapted to be quickly attached or detached on the inside surface of a transparent panel of the cabinet through which products are viewed by customers.

2. Description of the Related Art

Product point-of-sale display cabinets such as coolers and freezers contain a plurality of conventional shelf elements in the interior space of the cooler on which products are displayed. The cooler is provided with an openable access door having a large transparent panel through which the products on the shelves can be viewed. There exists an unused dead space between the inside surface of the door panel and the conventional shelf elements of the cooler. The dead space extends from side-to-side and top-to-bottom of the transparent door panel. While it has been desired to use this dead space for additional product display, existing shelves have not been entirely satisfactory for additional product display because of problems relating to retention, capacity and access to products on the shelf.

When the door is swung open, inertial forces are generated which can cause products on the display shelf to be dislodged. Therefore, door mounted display shelves must have some means for retaining products on the display shelf to prevent them from being dislodged as the door swings open. The retaining means most often used is a vertical retaining wall along the front edge of the shelf. A vertical retaining wall must satisfy three basic requirements that have in the past been irreconcilable. The retainer wall must be high enough to prevent the product from tipping over the top edge of the retainer (retentiveness); high enough to give the shelf adequate capacity to hold small size products (capacity); and low enough to permit convenient access of a hand for quick removal of the product (access).

A vertical retaining wall can easily meet retentiveness, capacity and access requirements when the products are all of a uniformly tall size and extend above the top of the retainer wall. However, when the products are all vertically short and small, or both large and small products are to be placed on the same shelf, problems arise with regard to retentiveness, capacity and access for removal of products.

In order to maximize the capacity of the shelf to hold small items such as candy bars, it is desirable to make the vertical retaining wall as high as possible. However, when the upper edge of the retaining wall is above the vertical height of a single product, access becomes more restricted and retrieval of the product starts to become more awkward and difficult. The higher the retainer wall relative to the vertical height of a single product, the more restricted the access becomes. If, for example, the candy bars are stacked horizontally four layers high, the top level of bars is easily accessed for removal but removal of the bars in the second, third or fourth levels becomes successively more difficult. In theory, it would be possible to stack products such as candy bars on end so that they project above the retainer wall, but this is not practical. As soon as some bars are removed, the remaining bars tend to fall down sideways, coming to rest on the shelf below the retainer wall where they are difficult to reach.

Ease of product removal is very important because it significantly affects operating costs. When the customer has trouble extending his fingers down over the top edge of the retainer wall for access to the candy bar, more time is taken in the removal process. The customer will hold the door open as long as necessary to remove the candy bar. Increase of door open time drastically increases the operating cost of the refrigerated cooler because a longer period of open time allows more refrigerated air to leave the cooler. Increasing the time the door is held open by only 15 or 20 seconds multiplied by thousands of openings during a typical week of operation results in an incredible increase in total operating cost of the refrigerated cooler. Open time not only increases operating costs but it also shortens the operating life of the cooler's refrigeration system.

The requirements for retentiveness, access and capacity have been even more difficult to meet when it is desired to place products of differing vertical dimensions on the same display shelf. With a tall product the retainer wall must be high to prevent the product from being dislodged when the door is abruptly pulled open. However, this high retainer wall can totally prevent access to a vertically short product placed on the same shelf. This problem has never been satisfactorily solved.

Therefore, the height of the retainer wall has, of necessity, always been a compromise in which retentiveness, shelf carrying capacity and access to products are all sacrificed to a significant degree. Historically, the only known way to avoid compromise of the retentiveness, access and capacity requirements is to provide a plurality of different shelves each with differing heights of retainer walls tailored to the size of the product. Unfortunately, tailored shelves also have unsatisfactory consequences. With tailored shelves, the merchant must purchase several different sizes of shelves thereby increasing his initial costs. Only some of these shelves are in use at any one time. The unused shelves must be stored and are subject to damage during handling and storage. Further, if a different size product is to be placed in the cooler, one size shelf must be removed and another installed in its place and this increases stocking time and labor costs.

With the teachings of the prior art it has not been possible to design a single, universal display shelf that will permit retentiveness, capacity and access requirements to be maximized for both tall and short products.

SUMMARY OF THE INVENTION

The object of the invention is to provide a single display shelf that is attractive, simple in design, economical to manufacture, and rugged in construction.

A further object of the invention is to provide a display shelf that is capable of displaying both tall and short products on the same shelf while maximizing retentiveness, capacity and access for removal of all different sizes of products placed on the shelf.

In accord with one aspect of the invention there is provided a product display shelf for a point-of-sale cabinet of the type that includes a transparent door panel having an inside surface, interior shelf elements and an unused space between said inside surface of said door panel and said interior shelf elements. The display shelf is detachably mountable on the inside surface of said door in the unused space and comprises a horizontal shelf for supporting products and having spaced apart inner, outer and end edges. A back wall is provided to extend in a generally vertical direction relative to the horizontal shelf. A suction type attachment means is mounted on the back wall to enable the shelf when in use to be detachably secured to the inside surface of said the panel. A product retainer wall extends substantially vertically from the shelf in spaced relation to the back wall and has an upper margin. A plurality of vertical access openings are provided in the retainer wall and are spaced in close proximity to each other along the full width of the shelf. The vertical access openings extend downward at least to a point that is closely adjacent to the outer edge of the shelf. A plurality of horizontal access openings are provided in the horizontal shelf and are spaced in close proximity to each other. The horizontal access openings extend toward said back wall inner edge. The vertical and horizontal access openings are dimensioned to provide a space through which fingers may be conveniently inserted to provide access for placing products on and removing them from the shelf means.

Preferably the display shelf has vertical access openings and horizontal access openings will both extend to the outer edge of the horizontal shelf. Each of the vertical access openings may be in alignment with a corresponding one of said horizontal access openings to form a plurality of integrated L-shaped vertical/horizontal access openings. In one embodiment of the display shelf the vertical access openings extend from the outer edge of the horizontal shelf and open through the upper margin of said retainer means to provide a plurality of freestanding vertical retaining fingers.

In another embodiment the vertical access openings terminate short of the upper margin of the retainer wall.

In either embodiment of the display shelf the horizontal shelf means may be provided with a reinforcing rib extending in spaced relation to the inner edge thereof.

In either of the embodiments the back wall may comprise a flange extending transversely outward from the inner edge of said horizontal shelf means and from inner margins of the shelf end walls with no portion of the back wall extending above the inner edge of the horizontal shelf. Preferably the flange comprises an integral U-shaped flange. The display shelf may comprise an integral unit composed of transparent material to maximize the view therethrough, when said shelf is installed, of other products inside of said cabinet that are not on the display shelf.

BRIEF DESCRIPTION OF THE DRAWINGS

Referring to the drawings.

BRIEF DESCRIPTION OF THE PREFERRED EMBODIMENTS

Figure 1:
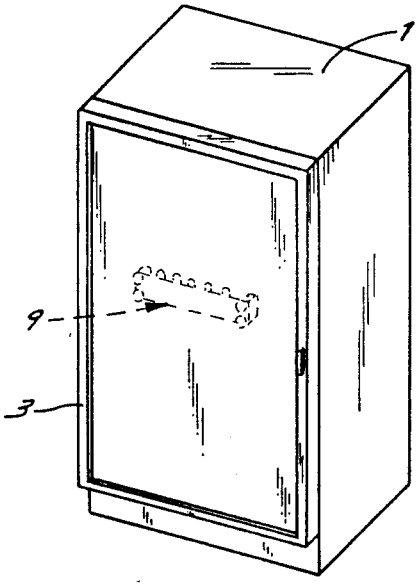
FIG. 1 is an isometric projection view of a cooler having a transparent door panel on which a display shelf constructed according to a first embodiment of the present invention is mounted.
Figure 2:
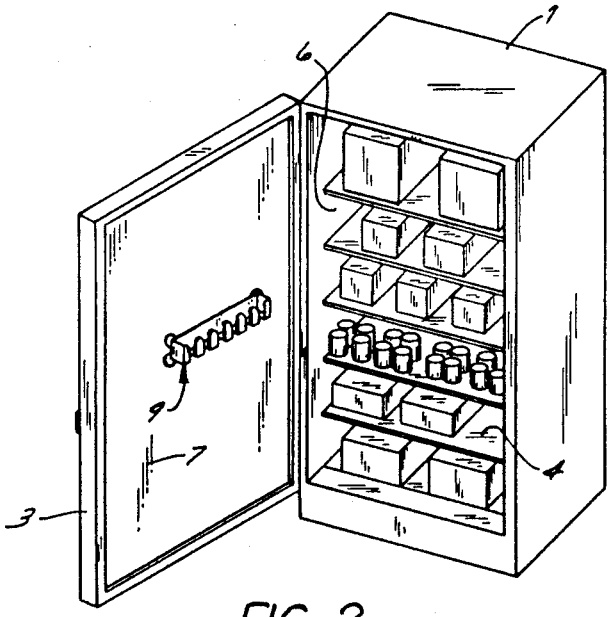
FIG. 2 is a view of the cooler cabinet shown in FIG. 1 with the door thereof in an open position to more clearly show a product display shelf mounted thereon.
Figure 3:
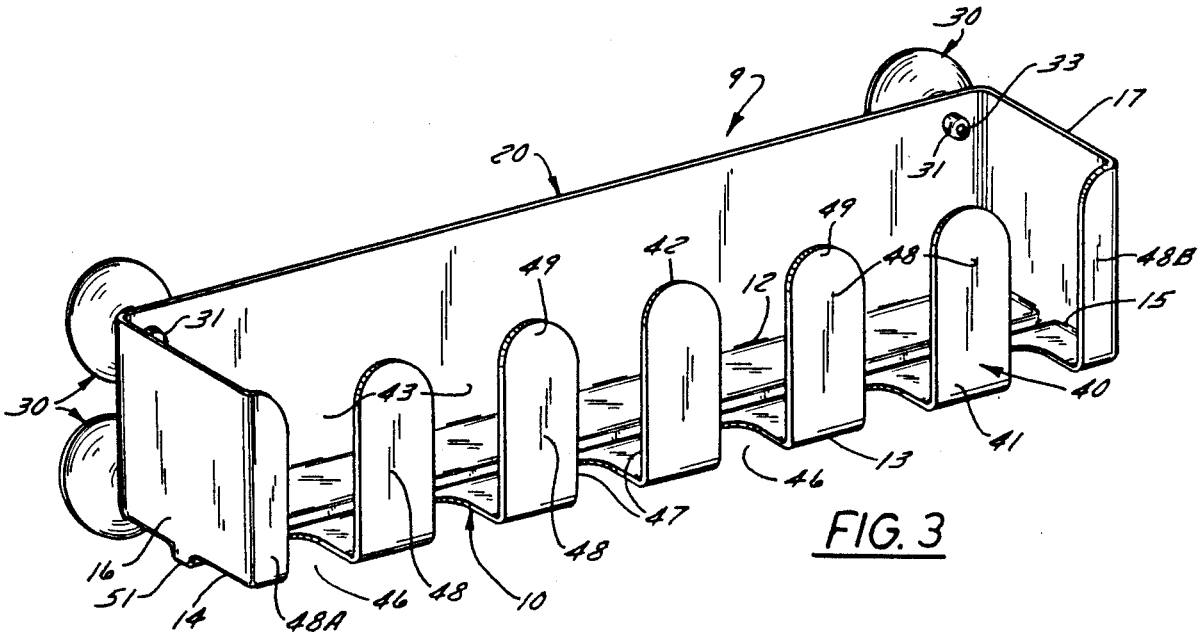
FIG. 3 is an isometric view of the first embodiment of the product display shelf shown in FIG. 2.
Figures 4, 5, 6:
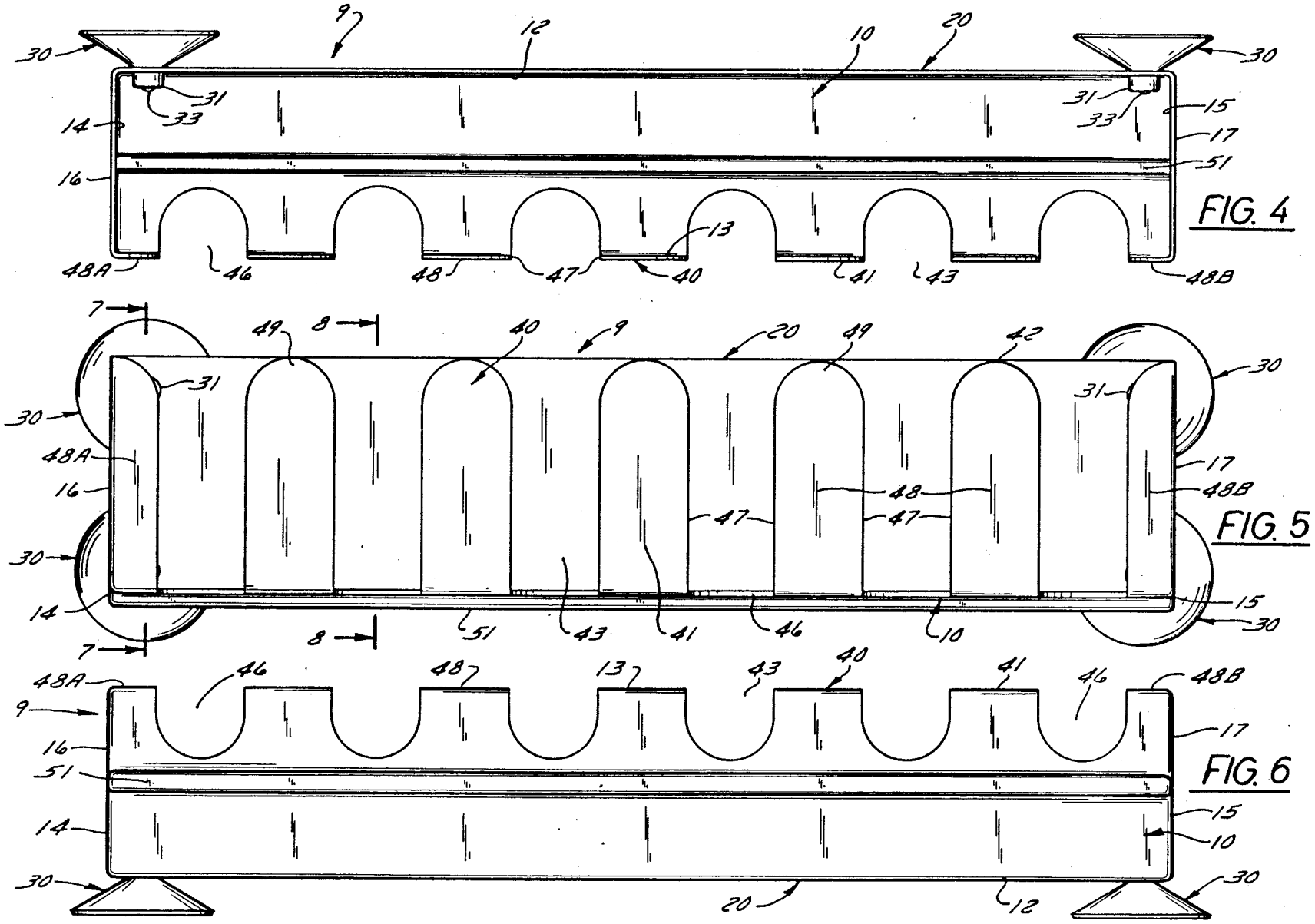
FIG. 4 is an enlarged top view of the display shelf shown in FIG. 3.
FIG. 5 is a front elevational view of the display shelf shown in FIG. 3.
FIG. 6 is a bottom view of the display shelf shown in FIG. 3.

FIGS. 1 and 2 show a display cabinet 1 such as a cooler or freezer. These coolers and freezers are normally used by retail merchants at a point-of-purchase location, such as a retail store, and have hinged transparent doors 3 through which customers can view products which are placed on conventional shelf elements 4 in the interior of the cooler. The doors 3 can be opened to permit the customer to remove the product which was first viewed through the door. Such coolers may be up to eight feet in height and the transparent portion of the door is normally made out of insulated glass. The construction of the cabinet is such that when the door 3 is closed there is a dead space 6 between the inner surface 7 of the door and the shelf elements 4 of the cooler which stretches from side-to-side and top-to-bottom of the transparent door of the cabinet.

Referring to FIG. 2, a first embodiment of the display shelf 9 is generally shown detachably mounted on the inner surface 7 of the transparent door panel to extend into the interior dead space 6. More than one display shelf 9 could be mounted on the door. The details of the first embodiment of the product display shelf 9 are best shown in FIGS. 3–8 and will now be described. As used herein, the terms "horizontal" and "vertical" have reference to the shelf when it is in a normal installed position as shown in FIG. 2.

Figure 7:
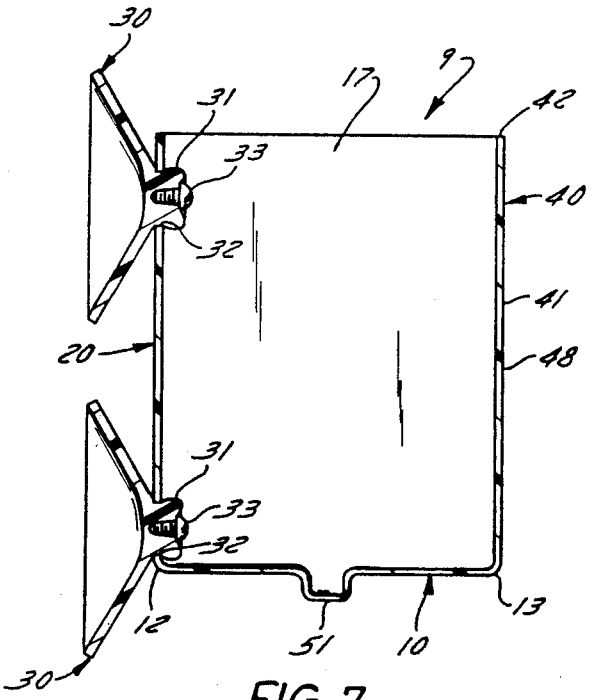
FIG. 7 is a sectional view taken along line 7—7 of FIG. 5.
Figure 8:
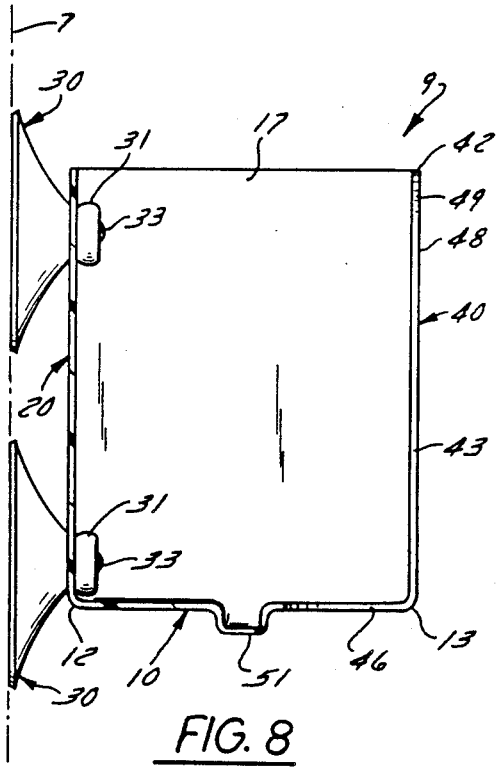
FIG. 8 is a sectional view taken along line 8—8 of FIG. 5.

Each product display shelf 9 includes a horizontal shelf means 10 sized to fit between the inner surface 7 of the door panel and the conventional shelves 4 of the cooler. Each shelf means 10 includes spaced inner and outer edges 12 and 13, spaced opposed opposite end edges 14 and 15 and end walls 16 and 17. A back wall means 20 is mounted to extend in a generally vertical direction relative to the inner edge 12 of the horizontal shelf means 10 between the opposite end walls 16, 17. Suction type attachment means 30 in the form of four suction cups are secured to the back wall means 20, as best shown in FIG. 7. Each suction cup has an expandable resilient button grommet 31 which is inserted through an aperture 32 in the back wall means 20. The grommet can be locked in its expanded condition by a locking screw 33 (FIG. 7) which will prevent removal of the suction cup from the back wall.

The shelf includes a retainer means 40 comprising a wall 41 extending substantially vertically from the outer edge 13 of the horizontal shelf means 10 in spaced relation to the back wall means 20. Wall 41 has an upper margin 42. The retainer means 40 also has a plurality of vertical access openings or slots 43 that extend from outer edge 13 in a substantially vertical direction. The vertical access openings 43 are spaced in close proximity to each other and open onto the outer edge 13.

A plurality of horizontal access openings or slots 46 are provided in the horizontal shelf means 10. The horizontal access openings 46 extend transversely between the outer edge 13 and the back wall inner edge 12. The horizontal access openings 46 are spaced in close proximity to each other and open onto the outer edge 13.

The vertical and horizontal access openings 43, 46 are dimensioned to provide a space that is wide enough so that the fingers of one hand may be conveniently inserted therethrough to either raise the product for removal by the other hand or to grip the product for direct removal without using the other hand. Preferably each vertical access opening 43 is in alignment with a corresponding one of the horizontal access openings 46 to form a plurality of integrated L-shaped vertical/horizontal access openings.

In the first embodiment the vertical access openings 43 extend upward from outer edge 13 and open through the upper margin 42 to define therebetween a plurality of spaced parallel freestanding vertical retainer fingers 48. The top portion 49 of each finger 48 may be rounded to increase the convenience of access. The end fingers 48A and 48B may be formed integral with end walls 16, 17. If desired, the vertical access openings 43 could be terminated short of the upper margin 42 as is the case with the vertical access openings 143 of the second embodiment shown in FIG. 9.

Preferably the shelf means, back wall means and retainer means comprise a unit composed of transparent material which is U-shaped in section to assure a field of view therethrough when said shelf is installed that will permit other products inside of said cabinet that are not on said display shelf to also be viewed by prospective customers.

As best shown in FIGS. 3–6, the horizontal shelf means 10 may be provided with a reinforcing rib 51 in spaced relation to inner edge 12. Preferably the reinforcing rib 51 is formed integral with the horizontal shelf means 10 to extend parallel to inner edge 12 continuously from one end edge 14 to the other end edge 15. The horizontal access openings 46 extend from the outer edge to the reinforcing rib 51.

As shown, the vertical access openings 43 define a plurality of vertical fingers 48 having straight line edges 47. However, the edges 47 of the fingers could be contoured in other than a straight line.

Figure 9:
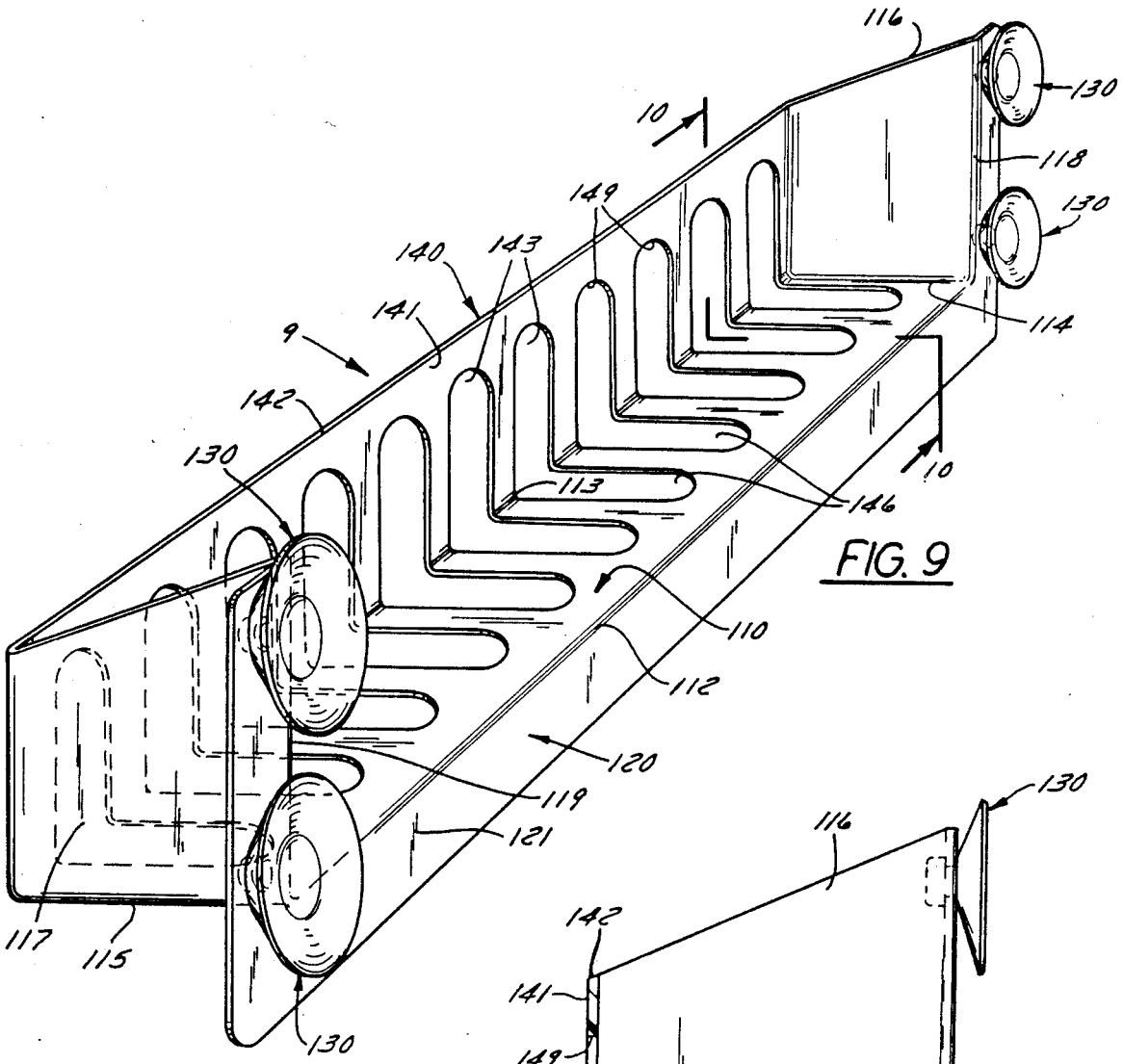
FIG. 9 is a perspective view of a second embodiment of the display shelf.
Figure 10:
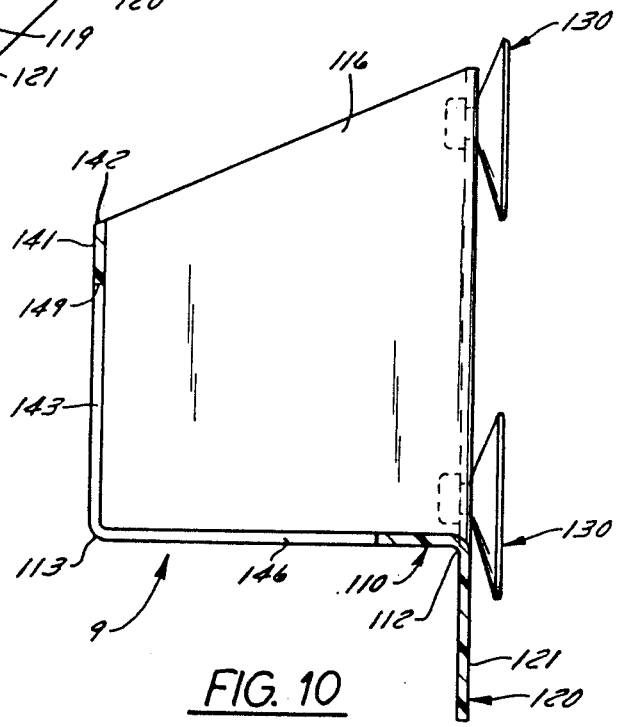
FIG. 10 is a sectional view taken along line 10—10 of FIG. 9.

The second embodiment of the display shelf is shown in FIGS. 9 and 10. The display shelf 9 of the second embodiment includes a horizontal shelf means 110 having spaced inner and outer edges 112 and 113, spaced opposite end edges 114, 115 and end walls 116, 117.

The second embodiment includes a back wall means 120 comprising a flange 121 which extends vertically downward from inner edge 112 and transversely outward away from the horizontal shelf means 110 and the inner margins 118, 119 of the end walls 116, 117. Preferably the flange 121 comprises an integral U-shaped flange. By directing the flange 121 transversely outward and away from the horizontal shelf means and the end walls 116, 117, a display shelf is provided wherein there is no back wall structure above the inner edge 112 of the horizontal shelf means 110. This second embodiment maximizes the visibility of products placed in the horizontal shelf means because products can be placed directly behind or against the inner surface 7 of the door without any transparent material intervening between the product and door panel.

Suction type attachment means 130 in the form of four suction cups are secured to the back wall means 120 in the same manner as described with respect to the first embodiment.

A retainer means 140 comprises a front wall 141 extending in a generally vertical direction relative to inner edge 112 between end walls 116, 117 and in spaced relation to the back wall means 120. Wall 141 has an upper margin 142 and a plurality of vertical access openings 143 that extend in a substantially vertical direction. The access openings 143 are spaced in close proximity to each other and open onto the outer edge 113. The access openings 143 terminate short of upper margin 142 and have their upper ends rounded at 149.

A plurality of horizontal access openings 146 are provided in the horizontal shelf 110 and extend transversely between the outer edge 113 and inner edge 112. The horizontal access openings 146 are spaced in close proximity to each other and open onto the outer edge 113.

The horizontal and vertical access openings are aligned with each other to provide a plurality of integrated L-shaped openings. The horizontal and vertical access openings are also dimensioned to function as described with respect to the first embodiment. The shelf means, back wall means and retainer means preferably comprise an integral unit of transparent material.

In both embodiments the front wall 41 or 141 comprising the retainer means 40 or 140 is shown as extending at 90° from the horizontal shelf means 10 or 110. The front wall in either embodiment could, however, be oriented at any other angle with respect to the horizontal shelf means that may be desired. The vertical and horizontal access openings are shown as being provided across the full width of the shelf but could be provided across only a part of the shelf where products so small in vertical height that they will lie below the upper margin are to be placed.

The embodiments shown and described are by way of example only and other modifications may be made without departing from the inventive concepts disclosed and claimed herein.

What is claimed is:

1. A product display shelf for a point-of-sale cabinet of the type that includes a transparent door panel having an inside surface, interior shelf elements and an unused space between said inside of said door panel and said interior shelf elements, said display shelf being detachably mountable on said inside surface of said door in said unused space comprising:

a horizontal shelf means for supporting products and having spaced apart inner, outer and end edges;

a back wall means mounted to extend in a generally vertical direction relative to said inner edge;

a suction type attachment means mounted on said back wall means to enable said shelf when in use to be detachably secured to said inside surface of said door panel;

a product retainer means extending substantially vertically from said shelf means outer edge in spaced relation to said back wall means and having an upper margin;

a plurality of vertical access openings in said retainer means spaced in close proximity to each other;

said vertical access openings extending between said upper margin and said outer edge;

a plurality of horizontal access openings in said horizontal shelf means spaced in close proximity to each other, said horizontal access openings extending between said outer edge and said back wall inner edge; and said vertical and horizontal access openings dimensioned to provide an access space through which fingers may be conveniently inserted for placing products on and removing them from said shelf means.

2. The display shelf according to claim 1 wherein said vertical access openings extend to said outer edge of said shelf means.

3. The display shelf according to claim 1 wherein said horizontal access openings extend to said outer edge of said shelf means.

4. The display shelf according to claim 1 wherein each of said vertical access openings are in alignment with a corresponding one of said horizontal access openings to form a plurality of integrated L-shaped vertical/horizontal access openings.

5. The display shelf according to claim 1 wherein said vertical access openings extend from said outer edge of the horizontal shelf and open through said upper margin of said retainer means to provide a plurality of free-standing vertical retaining fingers.

6. The display shelf according to claim 1 wherein said vertical access openings terminate short of said upper margin.

7. The display shelf according to claim 1 wherein said horizontal shelf means has a reinforcing rib extending in spaced relation to said inner edge.

8. The display shelf according to claim 7 wherein said horizontal access openings extend from said horizontal shelf outer edge to said reinforcing rib.

9. The display shelf according to claim 1 wherein said horizontal shelf has an end wall at each of said end edges, each of said end walls having a vertically extending inner margin; and said back wall comprises a flange means extending transversely from said inner edge of said horizontal shelf means and from said inner margins of said end walls.

10. The display shelf according to claim 9 wherein said flange means comprises an integral U-shaped flange.

11. The display shelf according to claim 1 wherein said shelf means, back wall means and retainer means comprise a unit composed of transparent material which is U-shaped in section to assure a field of view therethrough when said shelf is installed that will permit other products inside of said cabinet that are not on said display shelf to also be viewed by prospective customers.

* * * * *